United States Patent [19]

Hung

[11] 4,072,391

[45] Feb. 7, 1978

[54] ELECTRIC PLUG FORMED BY SQUEEZING ASSEMBLY

[76] Inventor: Jui Jung Hung, No. 584, Jui Lung Road, Kaohsiung, China /Taiwan

[21] Appl. No.: 714,234

[22] Filed: Aug. 13, 1976

[51] Int. Cl.[2] ..... H01R 11/02

[52] U.S. Cl. ..... 339/196 R; 339/99 R; 339/273 R

[58] Field of Search ..... 339/196 R, 196 M, 273 R, 339/273 F, 95 D, 98, 99 R

[56] References Cited

U.S. PATENT DOCUMENTS

| | | | |
|---|---|---|---|
| 1,674,246 | 6/1928 | Gaynor | 339/196 R |
| 1,898,359 | 2/1933 | Gilbert | 339/196 R |
| 2,970,288 | 1/1961 | Hubbell | 339/196 M |

*Primary Examiner*—Roy Lake
*Assistant Examiner*—Mark S. Bicks
*Attorney, Agent, or Firm*—Holman & Stern

[57] ABSTRACT

The plug comprises a plug base having an assembly cavity which has inserted therein two pole plates through the top portion of the plug base. A squeezing arm is formed on the pole plate for holding the wire in the pre-formed recessed hole. A fixing latch is further provided to fasten the pole plate and wire from the top of the plate. By this squeezing means, the electric wire is fixed sturdily and the plug can be easily assembled.

1 Claim, 8 Drawing Figures

ELECTRIC PLUG FORMED BY SQUEEZING ASSEMBLY

BACKGROUND OF THE INVENTION

The present invention relates to electrical plugs. The conventional plugs are movable and are assembled by means of bolt and nut. Whenever connecting the electric wire, a driver must be used to open the plug and the wire must be bent to wind on the bolt of the copper pole, then fasten the bolt. However, if the winding direction of wire is opposite against the rotation direction of bolt fastening, it is difficult to fix the wire on the copper pole resulting in future loosing and poor contact. Said plug will be loosed after periodical service. With the loosing of the bolt, the plug base may be separated from the copper pole. The conventional plug has been found inconvenient as it is operated, connected and assembled. It is unsafe for using. When maintenance is necessary, a driver of suitable size must be utilized to connect the electric wire.

Also known in the art is a solid and fixed type plug. However, said plug is fixed by filling the electric wire into the plug base. If the copper pole plate is separated from the wire within the plug, the plug will then be out of service. Furthermore, the factory produces such a plug with a specific of wire length which may not satisfy the customer's requirement. A wire that is too long will cause waste, too short will need further wire for its connection. If the fixed-type plug is provided with colored wire, the specific wire color may not satisfy the customer's interest.

The conventional movable plug is formed in that the conducting wire is aligned with the copper pole plate for their assembly. When plugging such a conventional plug into the socket, the plug may easily be pulled out from the socket if there is a draft force acting on the conducting wire.

Having reviewed the above-mentioned defects, the present inventor has improved and disclosed the present plug.

SUMMARY OF THE INVENTION

The present invention relates to a plug wherein a plug base is formed with an assembly cavity which allows the insertion of two pole plates. A squeezing arm is formed on the pole plate to squeeze the wire and connect the power through the pole and the conducting wire. A fixing latch is further provided to fix the copper pole plate and the wire. A squeezing arm is provided at the end of the pole plate so as to press the conducting wire into the assembly cavity pre-formed in the plug base to fix the wire sturdily.

Whenever assembling the present plug, the power cable to remove the outer insulating material to make nude the copper wires. Then lead the wires through the wire hole to be assembled with the pole plates. It is easier to assemble a plug. The wire may not be drawn and loosed after being fixed by the above-mentioned means.

Figure 1:
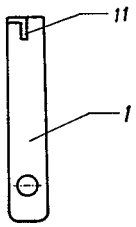
FIG. 1 is the front view drawing of the pole plate in accordance with the present invention.
Figure 2:
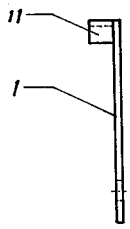
FIG. 2 is the right side view of FIG. 1.
Figure 3:
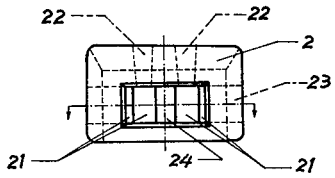
FIG. 3 is the top view drawing of the plug base.
Figure 5:
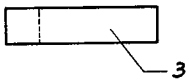
FIG. 5 is the top view drawing of the fixing latch.
Figure 6:
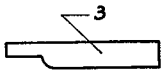
FIG. 6 is the front view of fixing latch.
Figure 4:
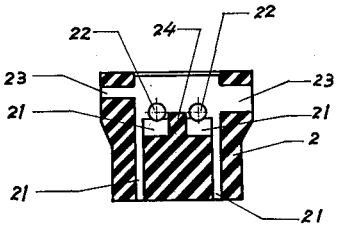
FIG. 4 is the front cross sectional drawing of the plug base.
Figure 7:
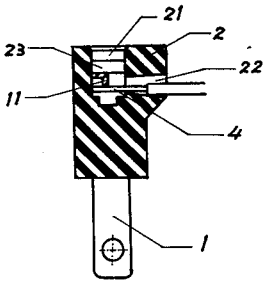
FIG. 7 is the cross sectional drawing of the plug assembly not yet fixed.
Figure 8:
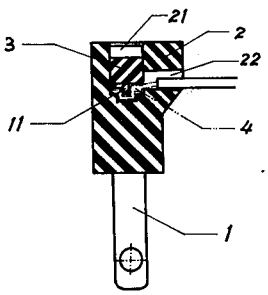
FIG. 8 is the cross sectional drawing of the plug assembly after being fixed.

DESCRIPTION OF THE PREFERRED EMBODIMENT:

As shown in the drawings, the present plug comprises the Copper pole plate 1, plug base 2 and the fixing latch 3.

Pole plate 1 is made from copper material. It is pressed to form a squeezing arm 11 which extends into the assembly cavity 21 in the plug base 2 so as to fix the wire 4.

Plug base 2 is made of insulating material having good temperature resistance. An assembly cavity 21 which is pre-formed in accordance with the shape of pole plate 1 and, after inserting the pole plate 1, allows the aperture for inserting the wire 4.

Two wire holes 22 are provided in plug base 2 to lead the conducting wire therethrough. Hole 22 directly passes through the assembly cavity 21 so that the wire 4 may be fixed by the squeezing arm 11 of the pole plate.

At the suitable position of base 2, a tunnel 23 for the insertion of fixing latch 3 is provided. When pole plate 1 is inserted into cavity 21 for fixing the wire, the back of the squeezing arm 11 of pole 1 is forced by the fixing latch 3 so as to pressurize the wire into the aperture between the squeeze arm 11 and the assembly cavity 21. The pole plate will not be retracted anymore so that the plug will be stabilized.

The assembly cavity 21 with pole slots and recesses for the insertion of pole plate 2. A partition 24 is located in the central cavity to prevent from short circuit as contacting the two wires.

When utilizing the plug 1 the following procedures may be applied:

a. Insert the two pole plates 1 into the assembly cavity 21 of plug base 2.

b. Strip the insulating material of power line to make nude the copper wires. Then twist the wires to made it dense as a cable.

c. Lead the above-mentioned wound wire 4 through hole 22 and then lead into the bottom hole of the squeezing arm 11 of pole plate.

d. Press down the pole plate 1. The squeezing arm 11 will force the wire 4 into assembly cavity 21.

e. Insert the fixing latch 3 through tunnel 23 to the specific position to assemble the present plug.

There are several changes which may be made without departing from the spirit and scope of the invention described in the foregoing specification and claimed in the following claim.

We claim:

1. An electric plug comprising at least one pole plate, each pole plate having a longitudinal axis, a transverse axis, two flat faces, edges and ends;

a squeezing arm on each pole plate at one end thereof, said squeezing arms being integral with said pole plate extending perpendicularly from one of said faces;

a connecting wire electrically associated with each pole plate;

a plug base, said base having an assembly cavity, a pole slot for each pole plate, a wire hole for each wire, at least one latch tunnel, a longitudinal axis, upper and lower ends, front and back faces, and a transverse axis perpendicular to the plane of said front and back faces, each pole slot extending through said lower end of said base terminating in said cavity and being aligned along said longitudinal axis of said base with the major axis of said slot parallel to said transverse axis, said assembly cavity being provided with a recess where each pole slot terminates, each wire hole extending through the back face of said base terminating in said assembly cavity at the recess where the associated pole slot terminates, each said wire hole being aligned parallel with said transverse axis, said at least one latch tunnel extending through said assembly cavity near the level of each wire hole above each recess; and at least one fixing latch;

each pole plate extending through a pole slot with its squeezing arm positioned in one recess; each connecting wire extending through a wire hole being fixed into the associated recess by the squeezing arm of the associated pole plate thereby making an electrical contact between each wire and the associated pole plate; at least one fixing latch extending through a latch tunnel pressing and fixing each squeeze arm against each connecting wire.

* * * * *